US007403152B2

(12) United States Patent
Gustafsson

(10) Patent No.: US 7,403,152 B2
(45) Date of Patent: Jul. 22, 2008

(54) METHOD AND ARRANGEMENT FOR REDUCING THE RADAR CROSS SECTION OF INTEGRATED ANTENNAS

(75) Inventor: Mats Gustafsson, Malmö (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 192 days.

(21) Appl. No.: 11/361,058

(22) Filed: Feb. 24, 2006

(65) Prior Publication Data

US 2007/0069940 A1 Mar. 29, 2007

Related U.S. Application Data

(60) Provisional application No. 60/656,395, filed on Feb. 28, 2005.

(51) Int. Cl.
*H01Q 17/00* (2006.01)

(52) U.S. Cl. ..... 342/1; 342/2; 342/3; 342/4

(58) Field of Classification Search ..... 342/1–4; 343/791, 792, 873

See application file for complete search history.

(56) References Cited

U.S. PATENT DOCUMENTS 5,170,175 A * 12/1992 Kobus et al. ..... 343/895
6,317,102 B1 * 11/2001 Stambeck ..... 343/900
6,414,645 B1 * 7/2002 Dahlberg ..... 343/767
6,937,184 B2 * 8/2005 Fujieda et al. ..... 342/70
7,006,050 B2 * 2/2006 Aisenbrey ..... 343/791

OTHER PUBLICATIONS

J. David Lynch, *Introduction to RF Stealth*, SciTech Publishing Inc., 5601 N. Hawthorne Way, Raleigh, NC 27613, 2004.
Knott, *Suppression of edge scattering with impedance strings*, IEEE Trans. Antennas Propagat., 45(12), 1768-1773, 1997.
Natzke et al, *Characterization of a resistive half plane over a resistive sheet*, IEEE Trans. Antennas Propagat., 41(8), 1063-1068, 1993.
Senior, *Backscattering from resistive strips*, IEEE Trans. Antennas Propagat., 32(7), 7474-751, 1984.
Volakis et al, *Broadband RCS reduction of rectangular patch by using distributed loading*, Electronics Letters, 28(25), 2322-2323. 1992.
Haupt et al, *Synthesis of tapered resistive strips*, IEEE Trans. Antennas. Propagat., 35(11), 1217-1225, 1987.
Senior et al, *Backscattering from tapered resistive strips*, IEEE Trans. Antennas Propagat., 32(7), 747-751, 1984.

(Continued)

*Primary Examiner*—Isam Alsomiri
(74) *Attorney, Agent, or Firm*—Nixon & Vanderhye, P.C.

(57) ABSTRACT

An antenna structure including an antenna 10 with an outer main surface 11, where said antenna 10 is integrated in a surface of a surrounding material 20. Further comprising a transition zone 30 arranged along the perimeter of the main surface 11 and overlapping the main surface, where the transition zone 30 comprises a layer of a resistive material with a resistivity that varies with the distance from an outer perimeter of the transition zone 30 to enable a smooth transition of the scattering properties between the antenna 10 and the surrounding material 20.

14 Claims, 12 Drawing Sheets

OTHER PUBLICATIONS

Holter et al, *Infinite phased-array analysis using FDTD periodic boundary conditions—pulse scanning in oblique directions*, IEEE Trans. Antennas Propagat., vol. 47, No. 10, pp. 1508-1514, 1999.

Orfanidis, *Electromagnetic Waves and antennas*, 2002. www.ece.rutgers.edu/~orfanidi/ewa, revision date Jun. 21, 2004.

* cited by examiner

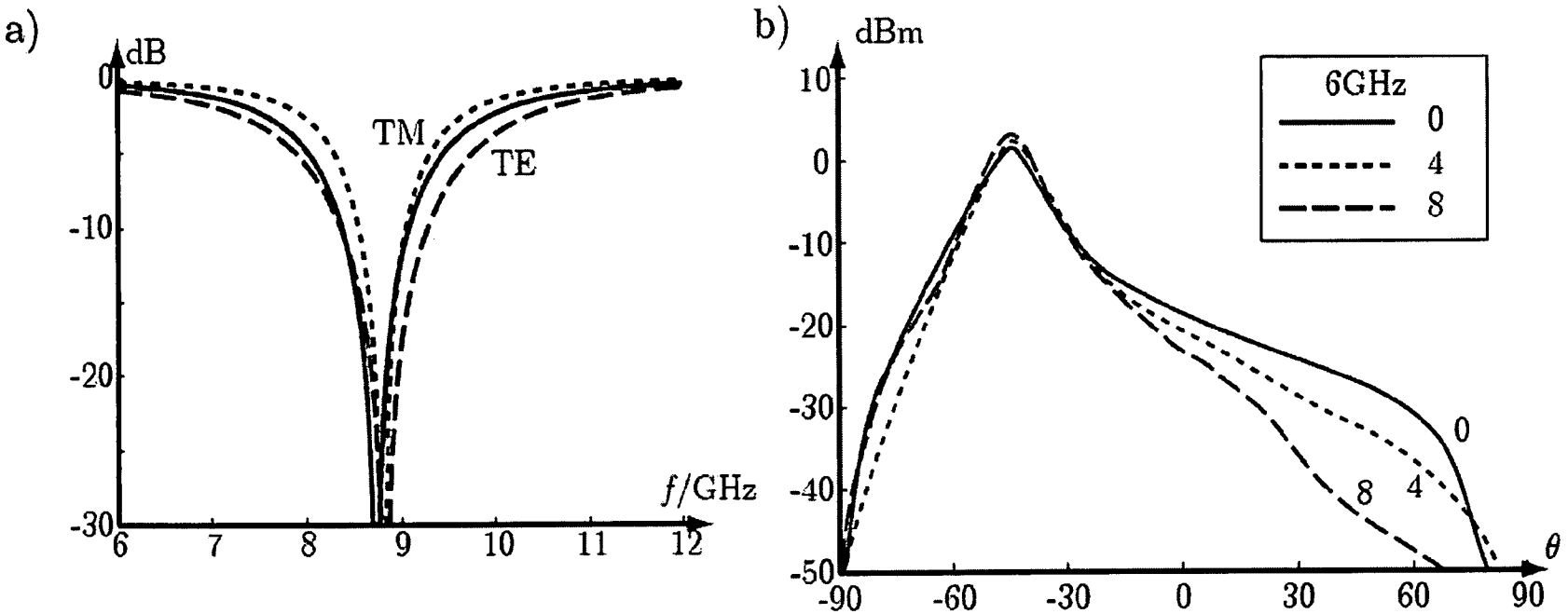
*FIG. 10 a-b*

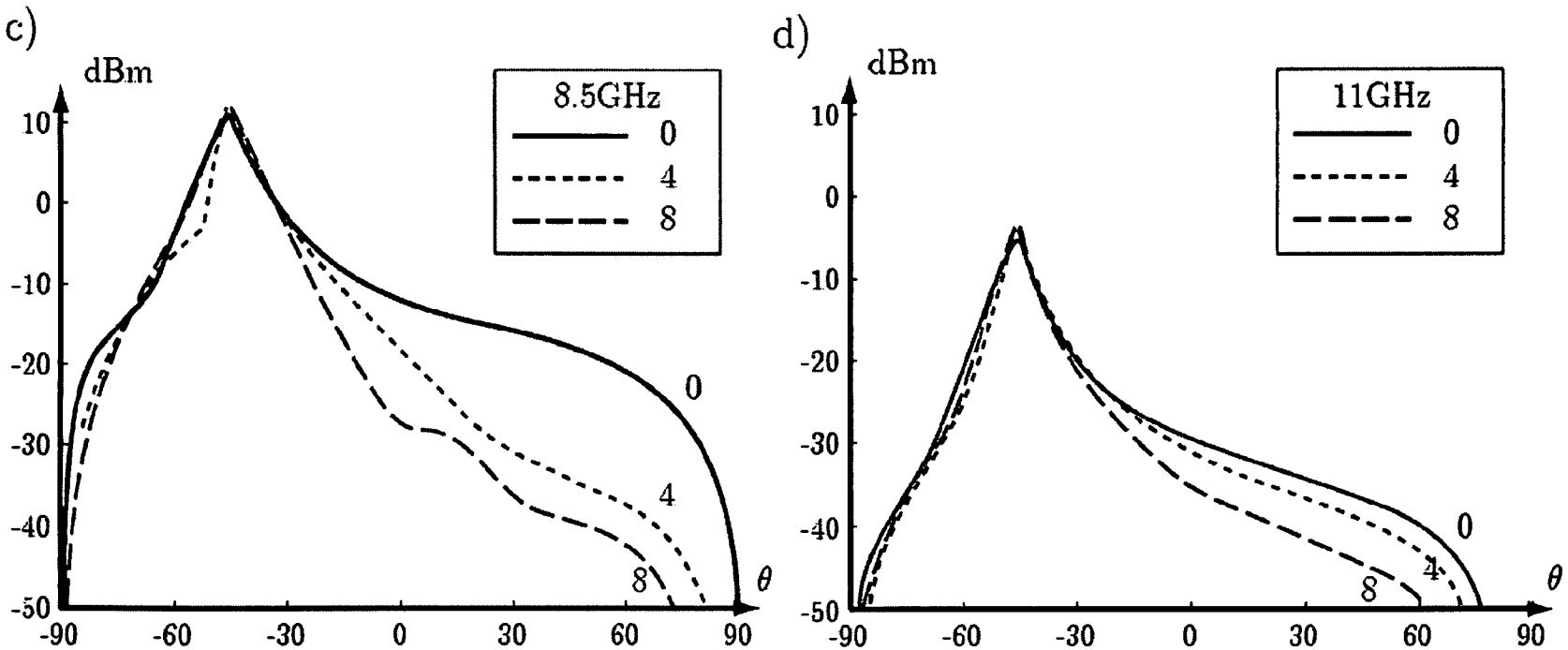
*FIG. 10 c-d*

METHOD AND ARRANGEMENT FOR REDUCING THE RADAR CROSS SECTION OF INTEGRATED ANTENNAS

This application claims the benefit and priority of United States Provisional Application 60/656,395, filed Feb. 28, 2005, which is incorporated herein by reference in its entirety.

TECHNICAL FIELD

The present invention relates to integrated antennas in general, specifically to methods and arrangements for the reduction of the radar cross section of such antennas.

BACKGROUND

During the past few years, the concept of stealth technology has been successfully exploited, especially for aircrafts. In its most basic definition, stealth is the art of going unnoticed through an environment. The aim is therefore to make it increasingly difficult to detect an object by means of e.g. radar or other electromagnetic detection technique. A plurality of designs, materials, and electronic devices has therefore been developed for this purpose.

Major potential sources of high radar visibility in stealth objects are antennas associated with the object. Since an antenna is typically designed to absorb energy in its operational band, the in-band diffraction is significant if the antenna is integrated in a non-absorbing environment. The out of band diffraction can also contribute to the so called radar cross section (RCS) if there is a phase difference between the reflection from the antenna and the reflection from the surroundings. Several phenomena have been identified as contributions to the radar visibility as represented by the radar cross section (RCS) of array antennas. These contributors can be divided according to: i) structural RCS, ii) antenna-mode RCS, i.e. reflections from inside the antenna, and iii) grating lobes i.e. above radio frequency (RF) band spikes. Examples of the various "classes" of contributors are e.g. grating lobes, edge diffraction, and surface waves The grating lobes can occur if the inter-element spacing is larger then half a wave length [[1, [2, [3].

Edge diffraction can be interpreted as diffraction caused by the rapid change in the scattering properties between the antenna and its surroundings [[4]. The out of band diffraction can also contribute to the RCS if there is a phase difference between reflections from the antenna and reflections from the antenna surrounding.

Therefore, there is a need for methods and arrangements to reduce the RCS of antennas.

SUMMARY

A basic object of the present invention is to reduce the radar visibility of antennas in stealth object.

A further object of the present invention is to enable reduction of the radar cross section of an antenna array integrated in a surrounding surface.

A further object is to enable a smooth transition of the scattering properties between an integrated antenna array and a surrounding surface.

A further object is to enable transformation of the scattering properties of an integrated antenna array to the scattering properties of a perfectly electrical conductor.

These and other objects are achieved in accordance with the attached set of claims.

Briefly, the present invention comprises providing a thin resistive sheet of a resistive material along the perimeter of an outer surface of an array antenna integrated in a surrounding material. The resistive sheet has a tapered resistivity distribution to provide a smooth transition of the scattering properties between the antenna and its surrounding material.

Advantages of the present invention include:

Smooth transition of scattering properties between an integrated antenna and its surrounding material;

An integrated antenna array with a reduced mono-static radar cross section

Reduced radar cross section of an integrated antenna.

BRIEF DESCRIPTION OF THE DRAWINGS

The invention, together with further objects and advantages thereof, may best be understood by referring to the following description taken together with the accompanying drawings, in which:

FIGS. 10*a-d* illustrate the bi-static RCS of embodiments according to the invention;

ABBREVIATIONS

Figure 1:
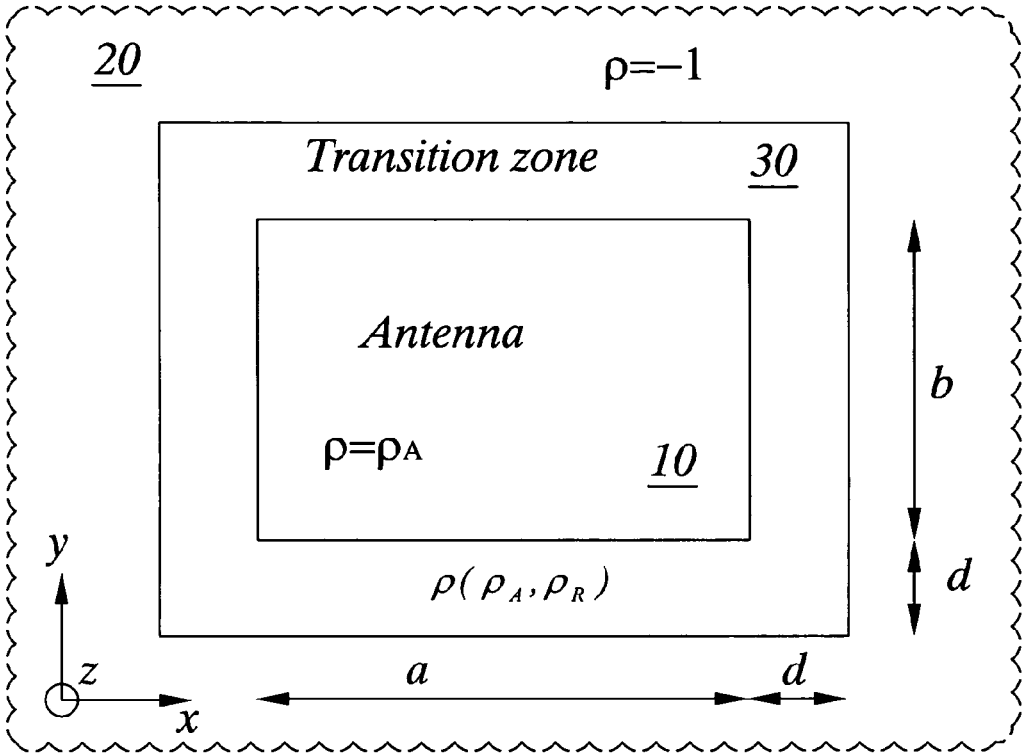
FIG. 1 is a schematic illustration of an embodiment of an arrangement according to the invention.

| | |
|---|---|
| RCS | Radar Cross Section |
| PO | Physical Optics (approximation) |
| RAM | Radar Absorbing Material |
| TE | Transverse Electric (polarization) |
| TM | Transverse Magnetic (polarization) |
| FDTD | Finite-Difference Time-Domain method |
| MoM | Method of Moments |
| FEM | Finite Element Method |

DETAILED DESCRIPTION

The present invention will be described in the context of but not limited to an array antenna integrated in a surface of a surrounding material, e.g. a perfectly electrical conductor surface. However, the same considerations are possible for other surrounding materials and for antennas with radome structures.

In order to fully comprehend the implications and various aspects of the present invention, some mathematical and theoretical considerations need to be explained.

RCS and Physical Optics Approximation

The basic definition of the Radar Cross Section (RCS) or a of an object is the ratio of the amplitude of the scattered power to the incident power in the direction of an observer at infinity. In other words, its equivalent area which if scattered isotropically would result in the same scattered power density [[5]. The RCS of an object can thereby be determined as the quotient between the amplitudes of the scattered wave and the incident wave, i.e., $$\sigma(\hat{r},\hat{k}) = \lim_{r\to\infty} 4\pi r^2 \frac{|E_r(r,\hat{r})|^2}{|E_i(\hat{k})|^2} = \frac{4\pi|F_s(\hat{r})|^2}{k^2|E_i(\hat{k})|^2} \tag{1}$$

where r is the position, k is the circular wave number, $E_s$ is the scattered wave and the incident wave $E_i$ is a plane wave according to $$E_1(x;\hat{k}) = E_i(\hat{k})e^{-ik\hat{k}\cdot x} \tag{2}$$

In general, the RCS of an object depends on the polarization and frequency of the incident wave. For two-dimensional objects, e.g., finite times infinite arrays, the RCS is the equivalent length of an object and given by $$\sigma(\hat{r},\hat{k}) = \lim_{r\to\infty} 2\pi\rho \frac{|E_s(\rho,\hat{r})|}{|E_i(\hat{k})|} \tag{3}$$

where ρ is the reflection coefficient of the object.

It is often convenient to use the logarithmic scale for the RCS. As the RCS is usually given in square meters or meters, this gives the units dBsm and dBm.

For the case of scattering from an antenna integrated in the surface of e.g. a PEC object it is natural to consider the scattering of the antenna as the scattering of the object with the antenna minus the scattering of the object when the antenna is replaced with PEC. The scattered field can be determined by integration of the currents on the surface of the object. Assume that the considered antenna array is planar and that is integrated in an infinite planar PEC surface. The current of the infinite PEC surface is given by $J_{PEC}=-2\hat{n}\times H_i$ or equivalently by a reflection coefficient $\rho_{PEC}=-1$. The total scattered field is obtained by integration of the electrical current J and magnetic current M on the surface.

For the scattered field from the antenna it is necessary to subtract the current $J_{PEC}$ over the entire surface area. This gives the scattered field as a Fourier integral over the antenna aperture, i.e.

$$\begin{aligned} F_s(\hat{r}) &= \frac{ik^2}{4\pi}\hat{r}\times\int\int_A (M(x)-\eta_o\hat{r}\times J(x)-J_1(x))e^{ik\hat{r}\cdot x}\,dS \\ &= -i\frac{k^2\eta_o}{2\pi}\hat{r}\times\hat{r}\times\int\int_A (J(x)-J_1(x))e^{ik\hat{r}\cdot x}\,dS \end{aligned} \tag{4}$$

where an equivalent model for an aperture in an infinite plane is used. The so called Physical Optics (PO) approximation gives a basic understanding of the scattering phenomena due to the geometry of the antenna aperture. The electrical current is approximated according to:

$$J_{PO}(x) = 2\rho(x)\hat{n}\times H_i = \frac{2\rho(x)}{\eta_o}\hat{n}\times(\hat{k}\times E_i)e^{-ik\hat{k}\cdot x} \tag{5}$$

where ρ(x) is the reflection coefficient of the antenna surface. Although the reflection coefficient is dyadic in general, it is sufficient to consider scalar reflection coefficients for the present analysis. The reflection coefficient depends on the spatial coordinate x, the frequency f the direction k̂, and the polarization of the incident wave $E_i$. This gives the PO approximation of the scattered field as $$F_{PO}(\hat{r},\hat{k}) = \frac{ipk^2|E_i|}{2\pi}\int\int_A (\rho(x)+1)e^{ik(\hat{k}-\hat{r})\cdot x}\,dS \tag{6}$$

where $\rho=\hat{r}\times(\hat{n}\times E_i)$. The physical optics approximation of the RCS then yields:

$$\sigma(\hat{r},\hat{k}) \approx \frac{k^2|p|^2}{\pi}\left|\int\int_A (\rho(x)+1)e^{-ik(\hat{k}-\hat{r})\cdot x}\,dS\right|^2 \tag{7}$$

Consequently, the mono-static RCS reduces to:

$$\sigma(\hat{k}) = \frac{k^2\cos^2\theta}{\pi}\left|\int\int_A (\rho(x)+1)e^{-2ik\hat{k}\cdot x}\,dS\right|^2 \tag{8}$$

Specular Reflection and Edge Diffraction

Consider the RCS of an antenna in the form of a square plate with side a and a reflection coefficient ρ0 in the PO approximation. Let the direction of an incident wave be given by $\hat{k}=\sin\theta\cos\phi\hat{x}+\sin\theta\sin\phi\hat{x}\mathbf{30}\cos\theta\hat{z}$. The mono-static RCS of the antenna is then calculated according to:

$$\begin{aligned} \sigma(\hat{k}) &= \cos^2\theta\frac{|\rho+1|^2}{\pi}\left|\int\int_A e^{-2ik(\sin\theta\cos\phi x+\sin\theta\sin\phi y)}\,dx\,dy\right|^2 \\ &= \cos^2\theta\frac{|\rho+1|^2}{\pi}\frac{\sin^2(ka\sin\theta\cos\phi)\sin^2(ka\sin\theta\sin\phi)}{k^2a^2\sin^2\theta\cos^2\phi k^2a^2\theta\sin^2\phi} \end{aligned} \tag{9}$$

Here, it is observed that the RCS is proportional to the contrast between the reflection coefficient in the antenna aperture and the surrounding material i.e. PEC. Moreover, the value of the RCS oscillates rapidly if ka >>1 and takes its largest value in the specular directions θ=0. Consequently, the edge diffracted field is strongest along the x and y axes, i.e. $\phi=0, 90°, 180°, 270°$. Observe that PO is not very accurate for this diffracted field. The so-called Physical Theory of Diffraction (PTD) could be used to improve the accuracy. However, PO illustrates the basic phenomena and it is sufficient for this analysis. The RCS is smallest along the $\phi=\pm45, \pm135°$. This illustrates the importance to align objects such that the incident waves are reflected in other directions than backwards, i.e. away from the observer.

Even though this example is very simple, it illustrates the basic phenomenon that has to be considered when designing an antenna array to provide a low (mono-static) RCS. First of all, it is necessary to orient the antenna array such that the specular reflection is directed in safe directions, i.e., away from the radar antenna. Second, it is important to reduce the amplitude of the diffracted waves as much as possible. The alignment of the edges of the antenna can also be used to direct the diffracted waves away from the radar antenna.

The specular reflection is in general no problem for an integrated antenna as it is directed in the same direction as the specular reflection of the body of the object, i.e., in a safe direction on a stealth object. Although the alignment can reduce degrading effect of the diffracted waves it is important to reduce their amplitude as it is difficult to avoid backscattered waves as well as multiple scattered waves in the mono-static direction.

According to a general aspect of the present invention it is necessary to eliminate the discontinuity in the reflection coefficient at the edge of the antenna, in order to reduce the amplitude of the diffracted waves.

Tapered resistive edge treatment is known to reduce edge diffraction and diffraction from impedance discontinuities [6, [4]. The resistive sheet is highly conductive $\sigma\approx\infty$ and very thin $d\approx0$, and is such that $\sigma d\approx R^{-1}$, see e.g. [4, [7, [8]. Such sheets are used in radar absorbing materials (RAM) such as Salisbury screens and Jaunmann absorbers [4]. They have also been used to taper the edges of antennas to free space [1, [9]. Their scattering properties are analyzed in depth in [10, [11].

A basic embodiment of the present invention comprises providing a transition zone with a tapered resistivity along the perimeter of an antenna array integrated in a surrounding material to provide a smooth transition of the scattering properties between the antenna and the surrounding material.

Figure 2:
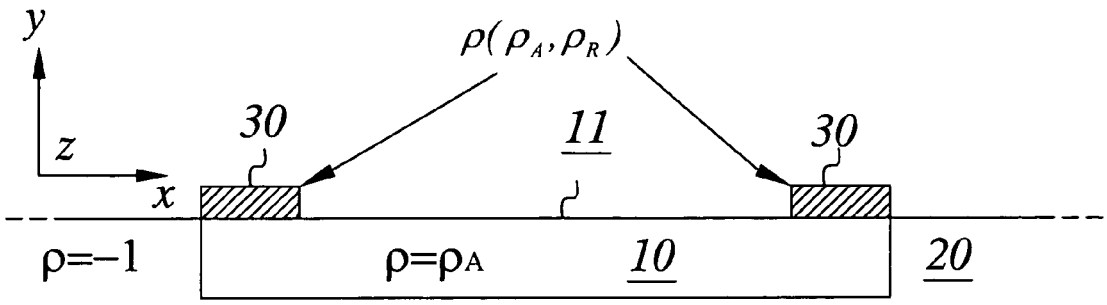
FIG. 2 is a cross section of the above embodiment.

FIGS. 1 and 2 illustrate two different views of an embodiment of an arrangement according to the invention. The arrangement includes a substantially flat antenna structure 10 integrated in a surface of a surrounding material 20. The antenna structure 10 is shown with but not limited to a rectangular shape. The invention is equally applicable to an arbitrarily shaped antenna.

Further, the arrangement comprises a transition zone 30 provided in the form of a thin resistive sheet. This zone 30 is arranged along the outer perimeter of the antenna 10 and extends or overlaps a main outer surface 11 of the antenna 10, leaving a central section of the antenna 10 un-covered. Simply put, the transition zone 30 circumvents the antenna surface very much like a frame circumventing a painting. In the illustration of FIG. 1 the transition zone 30 extends a distance d over the antenna surface from an outer perimeter of the transition zone 30.

In FIG. 2, the above described antenna structure is shown in a cross-section view, indicating the previously mentioned main outer surface 11 of the antenna 10 and the manner in which the transition zone 30 overlaps the antenna surface 11.

Also indicated in the FIGS. 1 and 2 are the reflection coefficients of the various components. However, the actual values of the respective coefficients are not limited to what is indicated in the FIGS. 1 and 2 but can be varied within the inventive concept.

In order to provide the requested smooth transition in the scattering properties across the interface between the surface of the surrounding material 20 and the main outer surface of the antenna 10 the transition zone 30 has a tapered resistivity profile. The resistivity of the transition zone varies with the distance d from the outer perimeter of the transition zone inwards over the antenna surface. According to a specific embodiment, the resistivity of the transition zone is dependent of the resistivity of the surrounding material and of the resistivity of the antenna main outer surface 11.

Even though the above illustrations show the outer perimeter of the transition zone 30 as coinciding with the outer perimeter of the main surface 11 of the antenna, it is implied that the transition zone 30 can overlap the surrounding material 20 as well. For that case, the scattering properties of the transition zone overlapping the surrounding material matches the scattering properties of the surrounding material.

Preferably, the transition zone extends continuously along the entire perimeter of the main surface 11. However, for some applications it might be beneficial or necessary to allow gaps or other irregularities in the transition zone. In addition, the transition zone 30 is illustrated as being of equal width d along the entire main surface 11. It is implied that also the width can vary depending on the application.

The above-mentioned resistive sheet is preferably highly conductive and $\sigma\approx\infty$ very thin $d\approx0$ such that $\sigma d=R^{-1}$. Especially, suitable materials for the sheet is selected from a group commonly used in radar absorbing materials (RAM) such as Salisbury screens, conductive paint and conductive films. The materials are also found on metallic coating on so-called low-emittance windows.

The theoretical considerations for the provisions of the transition zone 30 in the form of a thin resistive sheet are described more in detail below.

Thin Conducting Sheet

As previously stated, in order to reduce the diffracted field of an antenna array it is necessary to provide a smooth transition of the scattering properties i.e. RCS over the interface between the antenna array and the surrounding material e.g. PEC.

According to an embodiment of the invention the transition zone 30 is in the form of a thin resistive sheet (preferably metallic) with high conductivity, i.e. thickness $d\rightarrow0$ and conductivity $\rho\rightarrow\infty$ such that $cd=R^{-1}$ is finite, arranged on the outer main surface 11 of the antenna 10.

The reflection coefficient of the sheet is, according to the invention, determined by (the derivation of the expression is shown in Appendix I):

$$\rho_R = \frac{-\eta_T}{2R+\eta_T} \tag{10}$$

where R is resistivity of the sheet and $\eta_T$ is the transverse wave impedance, i.e. $\eta_T=\eta_0/\cos\theta$ and $\eta_{TM}=\eta_0\cos\theta$ where $\theta$ is the incident angle. It is easily seen that $\rho_R$ is real valued and $-1\leqq\rho_R\leqq0$. The corresponding transmission coefficient is similarly given by $\eta_R 1+\rho_R$.

Figure 3:
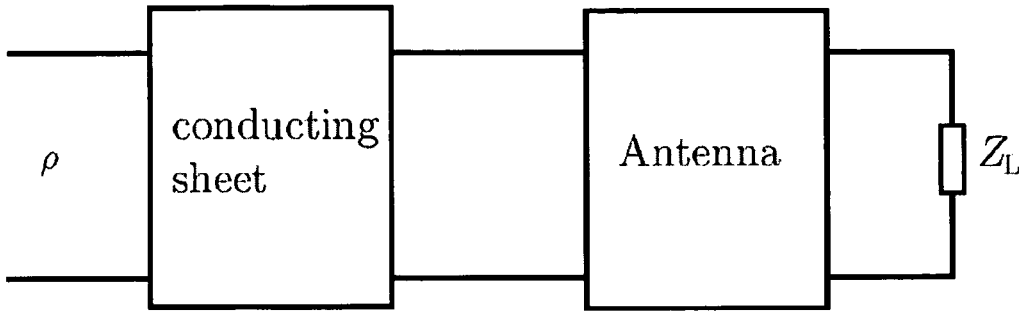
FIG. 3 is a schematic illustration of a circuit model of the embodiment in FIG. 1.

The corresponding circuit model for the antenna and the transition zone is illustrated by FIG. 3.

For the specific embodiment of an antenna integrated in the surface of a PEC, let the resistance be zero i.e. equal to the resistance of the surrounding material e.g. PEC at the outer perimeter of the transition zone and increase to infinity i.e. air at distance d from the edge. The reflection coefficient of the combined sheet and antenna is given by $$\rho' = \frac{\rho_R + \rho + 2\rho_R\rho}{1 - \rho_3\rho} \tag{11}$$

This represents a conformal map mapping −1 to 1. The unit circle is mapped into a circle centered at $$2\rho_R/(1-\rho_R) = \frac{-\eta_T}{R+\eta_T} \tag{12}$$

with radius $$\frac{1+\rho_R}{1-\rho_R} = \frac{R}{R+\eta_T} \tag{13}$$

A reflection coefficient follows the "inverted" reactive circles towards ρ'=−1 as R→0. See FIG. 4.

The mono-static RCS for the arrangement is given by $$\sigma(\theta, k) = \cos^2\theta\frac{k^2}{\pi}\left|\int(1+\rho'(x))e^{-2ikx\sin\theta}dx\right|^2 \tag{14}$$

This expression is easily evaluated for any arbitrary transition zone $\rho_R(\tau)$. The RCS can also be approximated as $$\rho' = \rho'' + \rho' - \rho'' \tag{15}$$

where ρ" is given by ρ+1 convolved with a smooth function having unit area, i.e., $$\rho'' = \Psi^*(\rho+1) - 1 \tag{16}$$

Figure 4:
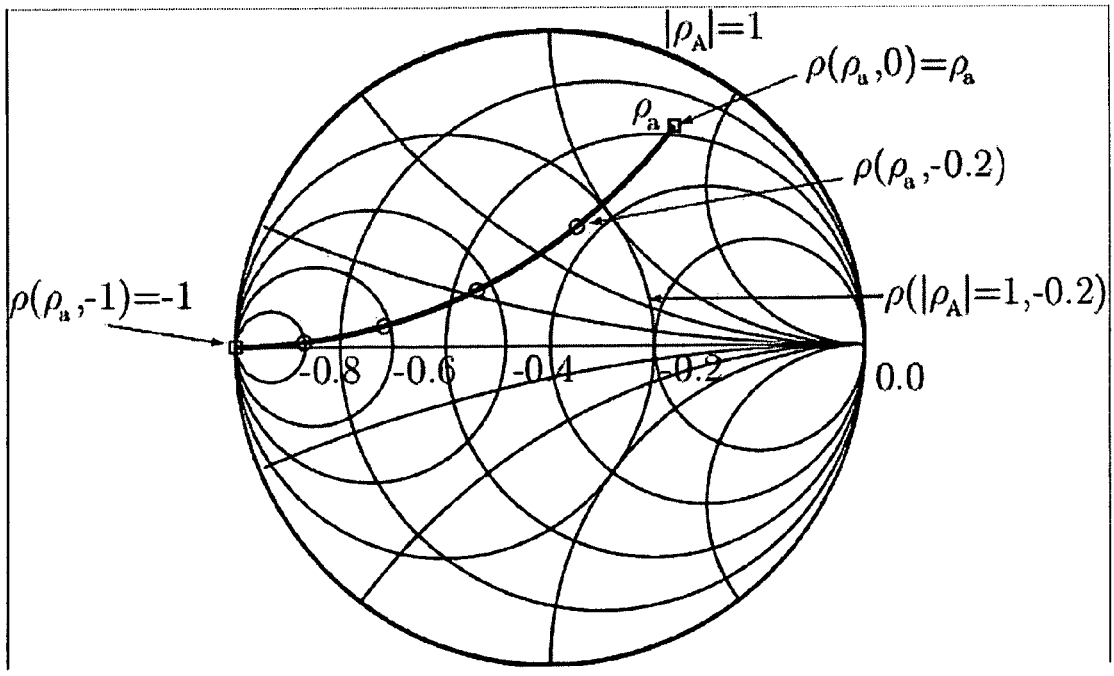
FIG. 4 illustrates the transformation of the reflection coefficient according to embodiments of the present invention.

The convolved reflection coefficient follows a straight line from ρ to −1, see again FIG. 4. The two parts of the RCS are evaluated as $$\sigma_{\rho''} = \hat{\Psi}(2k\sin\theta)\sigma_0 \tag{17}$$

The first part can be made arbitrary small for a sufficiently large transition zone. The second part is given by the Fourier transform of the difference between the 'inverted' reactive circles and the straight lines. The worst case is given by ρ=+1.

Figure 5:
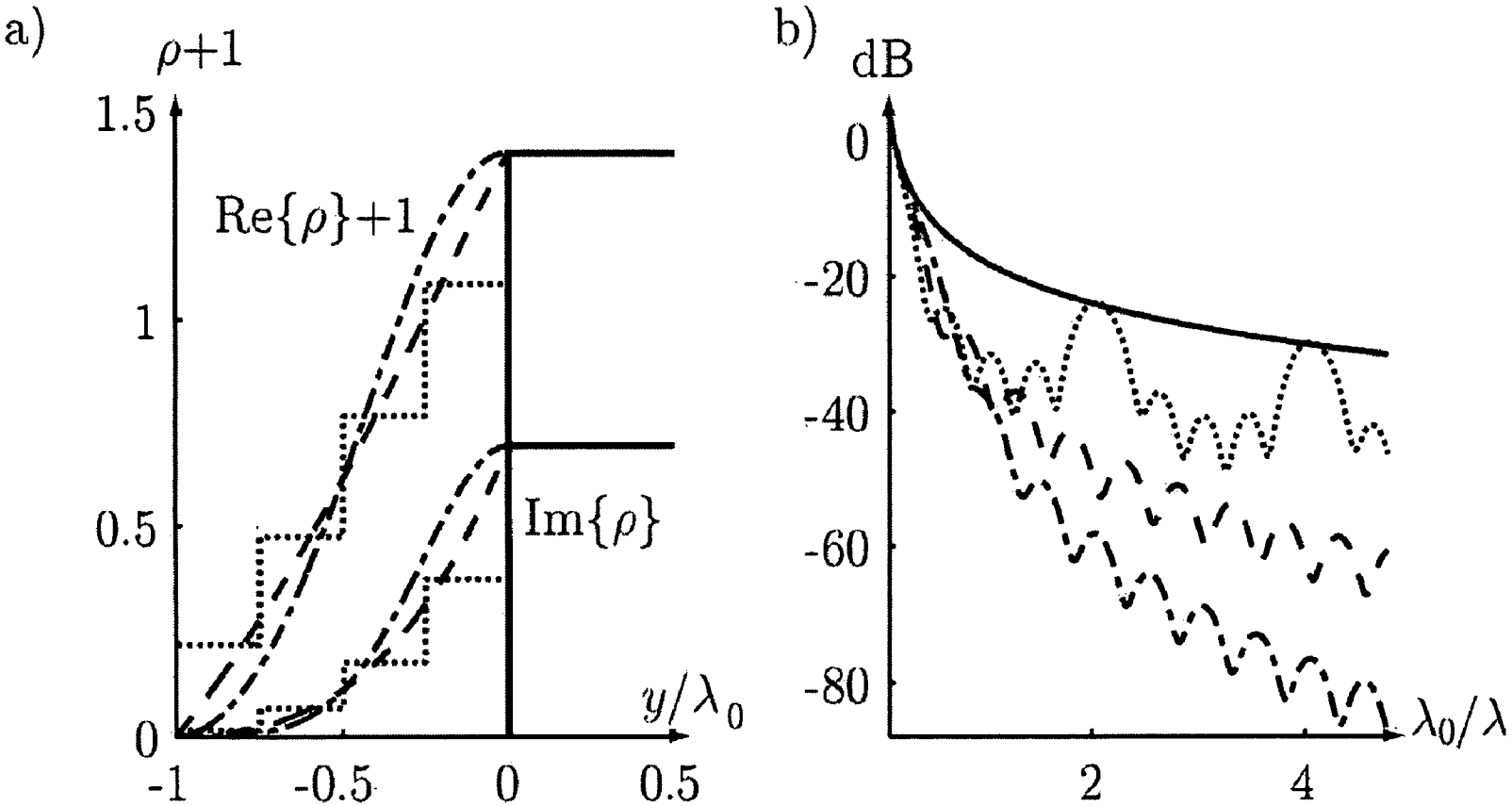
FIG. 5*a* illustrates the transition of the reflection coefficient according to the invention.
FIG. 5*b* illustrates the Fourier transforms in dB of the transition of FIG. 5*a*.

To illustrate the effectiveness of the conducting sheet, consider an example with a piecewise constant, a linear, and cubic spline interpolation of the reflection coefficient, see FIG. 5*a* and the corresponding Fourier transform in FIG. 5*b*. Here it is seen that the resistive tapering reduces the RCS. There is no major difference between the three cases for low frequencies i.e. $\lambda > \lambda_0 \approx 0.25$*length of the transition zone. For higher frequencies the improvement is noticeable for the smooth transition.

NUMERICAL EXAMPLES

Numerical simulations are used to illustrate the reduction of the RCS two different array antennas. Consider the infinite times finite arrays. The infinite antenna array can be simulated in a known manner using either one of the Finite-Difference Time-Domain method (FDTD), Method of Moments (MoM), or Finite Element Method (FEM) as long as the code can handle periodic boundary conditions [2, [12, [13]. Here, the code Periodic Boundary Finite-Difference Time-Domain method (PB-FDTD) developed by H. Holter [13] is used.

Self-Complementary Patch Array

According to an embodiment of the present invention, consider an infinite antenna array comprising a plurality of PEC patches. The patches are fed at the corners of each patch giving a linear polarized field in the +45° directions depending on the used feed points. The patch array is almost self complementary, i.e., the PEC structure is almost identical to its complement.

Transformation zones according to the invention are provided on the outer main surfaces of the antenna array. The reflection coefficient of the antenna array varies according to FIG. 6*a* and FIG. 6*b*. The dielectric sheets according to the invention act as a filter matching the antenna for a range of frequencies $f_i \cdot f \cdot f_u$. The upper frequency $f_u$ is limited by the onset of grating lobes and the destructive interference from a ground plane at half a wavelength distance. Hence, the ground-plane distance and the inter-element spacing are much smaller than the wavelength at the lower frequency $f_i$. In analogy with quarter-wave transformers in broadband matching, the ground plane distance and the sheets are chosen to be of equal optical thickness, i.e., a sheet thickness of $d/\sqrt{\epsilon_1}$ is used [2, [3, [14]. The case with a single dielectric sheet is easily analyzed with a parametric study.

Here, we consider a patch array with dimensions a=9.6 mm, b=0.8 mm and h=13.6 mm giving the unit-cell length $l_0$=20.8 mm. This gives a resonance frequency around 5.5 GHz and the onset of grating lobes at 7.5 GHz. Dielectric sheets with permittivity $\epsilon_1$=7 and $\epsilon_2$=3 are used. We consider an array consisting of 20 unit cells in the y direction, giving $l=20l_0$=416 mm, and an infinite amount of unit cells in the x-direction, i.e. periodic boundary conditions in the x-direction. As a plane wave in the yz-plane impinges on the array, it is convenient to use the polar angles θ in the range $$-\frac{\pi}{2} \le \theta \le \frac{\pi}{2}.$$

Figure 7:
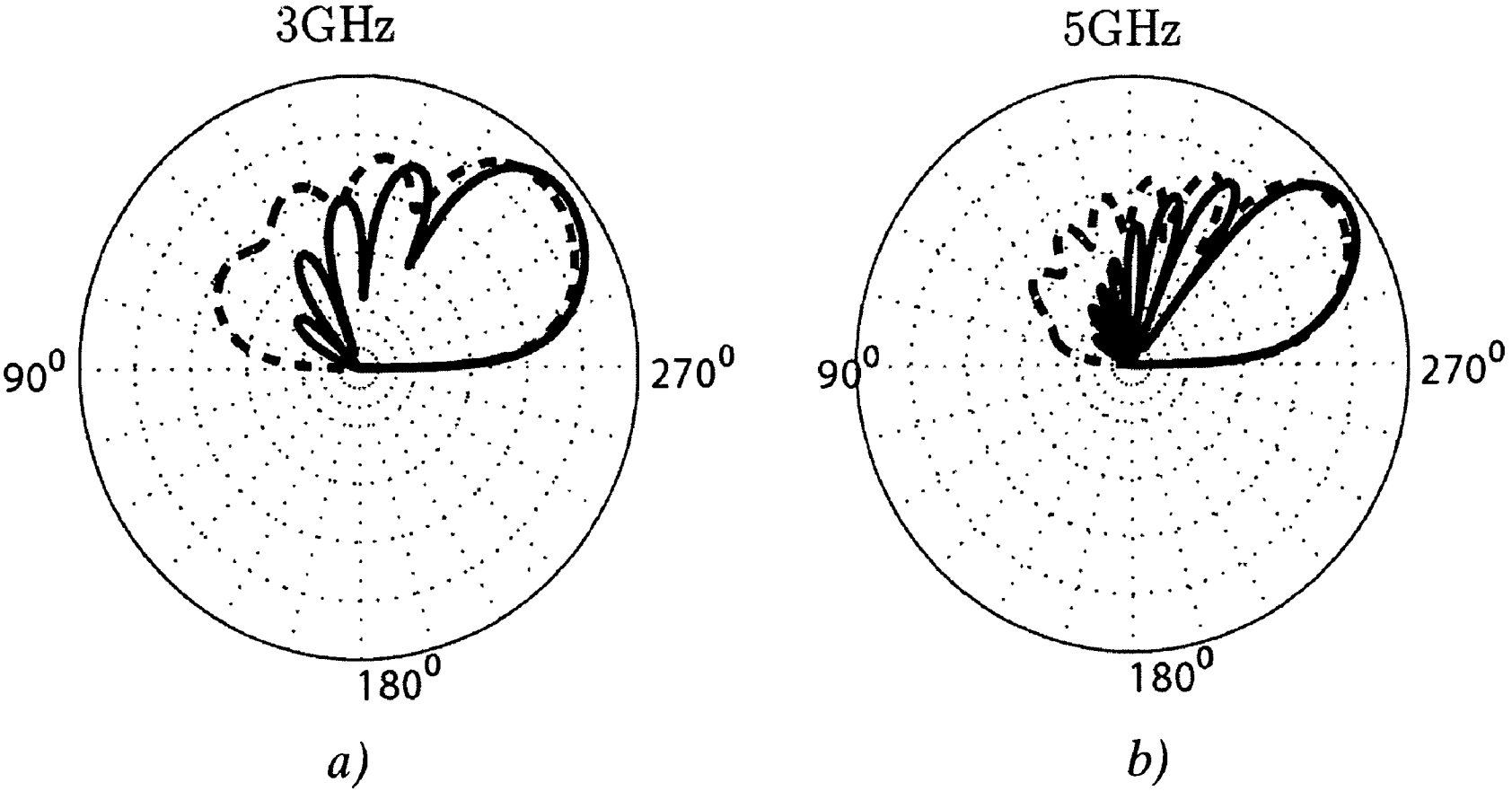
FIGS. 7*a-b* illustrate the calculated bi-static RCS of a self-complementary patch array according to an embodiment of the present invention, FIGS. 8*a* and *b* illustrate the same information as FIGS. 7 and *b*.
Figure 8:
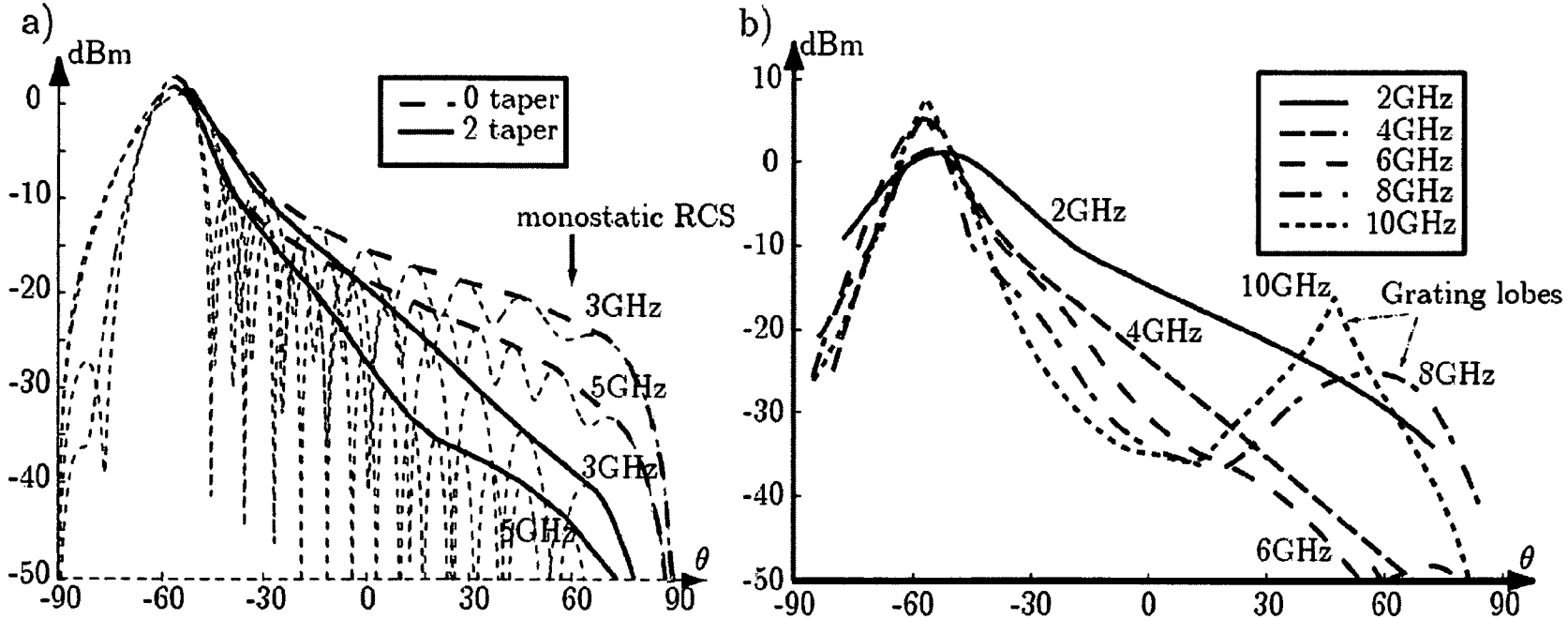

The bi-static RCS of a self complementary patch array with a single dielectric sheet according to the above is illustrated graphically in FIG. 7*a* and FIG. 7*b*. In this case the dielectric sheet can be designed to give one single loop in the centre of the Smith chart. Another way to plot the same information is illustrated in FIGS. 8*a* and 8*b*, where the RCS is plotted as a function of the reflected angle. Both the results for a structure with the tapered transition zone according to the invention and without the transition zone are shown.

As expected, the specular reflection at −60' dominates the bi-static RCS. The oscillations of the RCS away from the specular direction are due to the constructive and destructive interference of the edge diffracted waves. The oscillations are more rapid for large arrays. The envelope of the RCS is highlighted to emphasize the dependence of the size of the array. The mono-static RCS is approximately −20 dBm at 3 GHz and −25 dBm at 5 (Hz for the integrated array without tapering. With a linear tapering over two unit cells, i.e. $d=21_0$=42 mm, the mono-static RCS reduces with approximately 20 dBm.

Figure 6:
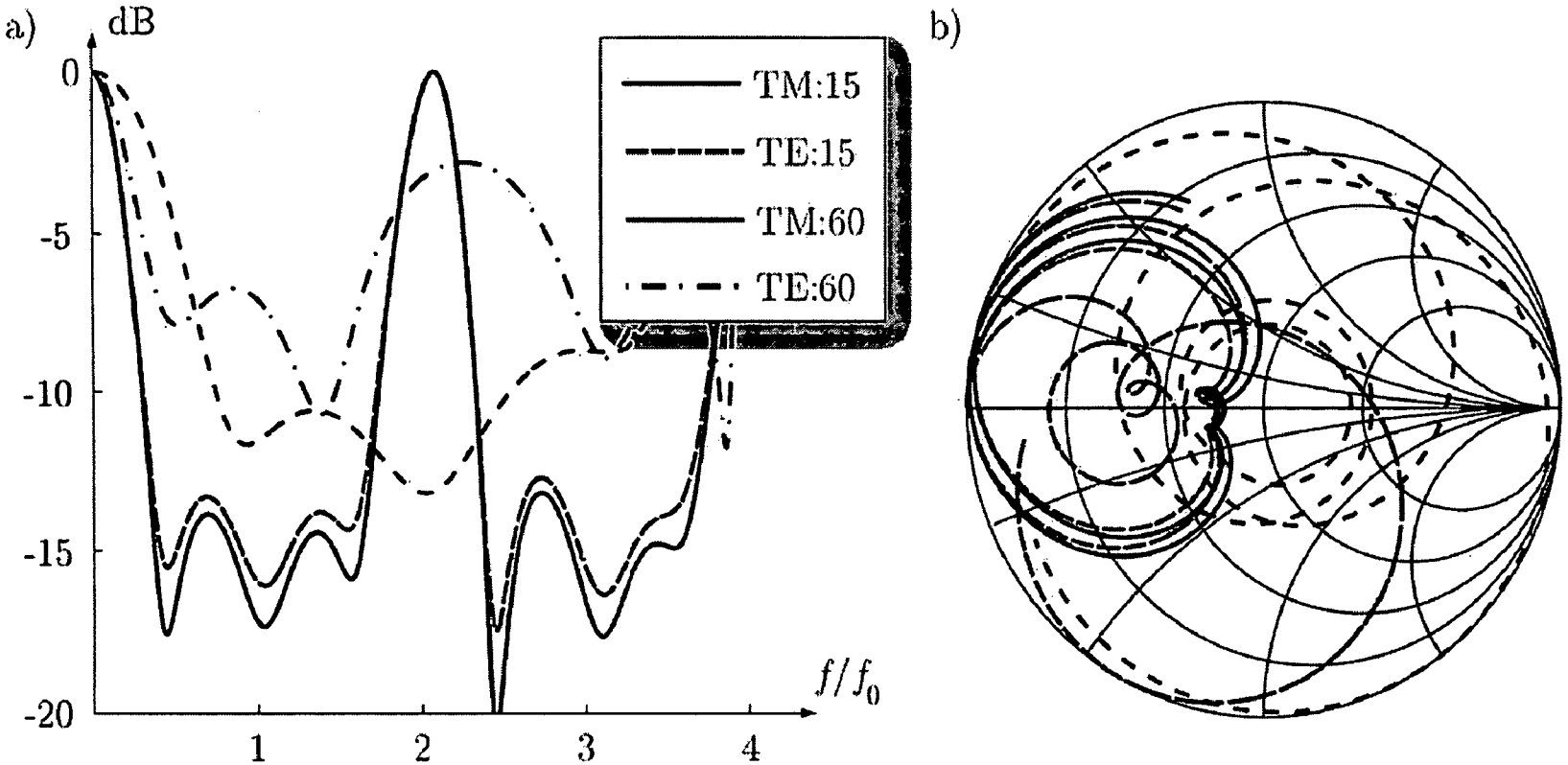
FIG. 6*a* illustrates the calculated reflection coefficient (expressed in dB) as a function of frequency of an embodiment of the invention.
FIG. 6*b* illustrates the calculated reflection coefficient (expressed in a Smith chart) as a function of frequency of an embodiment of the invention.

The resistive tapering reduces the RCS by smoothing out the discontinuity between the antenna and its surrounding material. However the RCS of an array can be significant if the array supports grating lobes. These grating lobes can occur if the inter element spacing in the array is larger than half a wave length. The path array supports rating lobes for frequencies above 7.5 GHz. The RCS of the self complementary 24×∞ array with a linear resistive tapering over the 2 edge elements for an illumination from θ=60° at 2, 4, 6, 8, 10-GHz is shown in FIG. 6*b*. As seen in the figure the mono-static RCS is very small for frequencies up to the onset of grating lobes at 7.5 GHz. The beam width of the grating lobes as well as the specular lobe depends on the size of the array. The beam width decreases for larger arrays.

It is also possible, if not shown that the invention can be further amended to comprise a broadband dipole array with two dielectric sheets.

Frequency Selective Radome (FSS)

Figure 9:
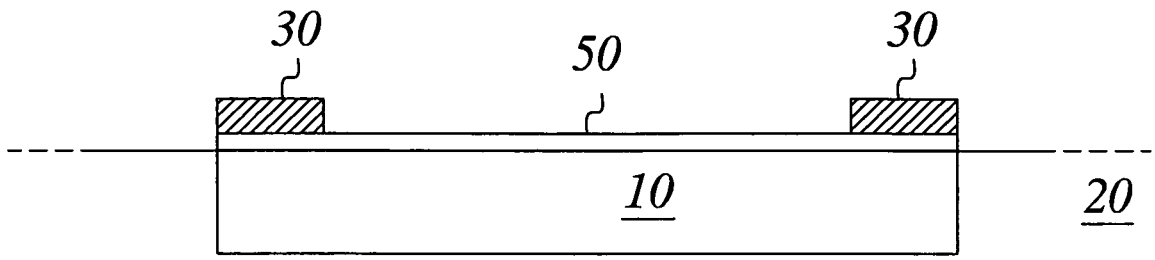
FIG. 9 illustrates a cross section view of an embodiment of the present invention.

Also consider the RCS of a finite times infinite FFS radome provided on top of the antenna structure of the invention, see FIG. 9. Consider a symmetric hybrid radome with four legged loop element.

The elements are arranged in a square grid with side length of $l_0$=6.6 mm and they have a slot width of 0.17 mm. The loop elements are placed in a 3 mm thick dielectric sheet with permittivity $\epsilon_r$=1.6. This gives a bandpass structure with passband from 8.5 GHz to 9 GHz, see FIG. 10*a*. The radome is integrated into a PEC structure and an antenna is placed under the radome. The upper dielectric sheet is placed 5 mm from the inner side of the radome.

For illustration purposes consider the three cases: without tapering, with a 26 mm linear taper, and with a 53 mm linear taper. The radome size excluding the taper is 332 mm×1. The finite length corresponds to 50 unit cells. The bi-static RCS is shown in FIGS. 10*b*, 10*c*, and 10*d* for a TE wave at 45° and the frequencies 6, 8.5, 11 GHz, respectively. The envelope of the RCS is highlighted to emphasize the amplitude of the edge diffracted part. As expected the specular reflection is largest in the passband, i.e., at 8.5 GHz, where the radome discontinuity between the radome and PEC is large. For frequencies outside the passband, the radome is highly reflecting and the discontinuity smaller. The effect of the tapering is negligible in the specular reflection.

Figure 11A:
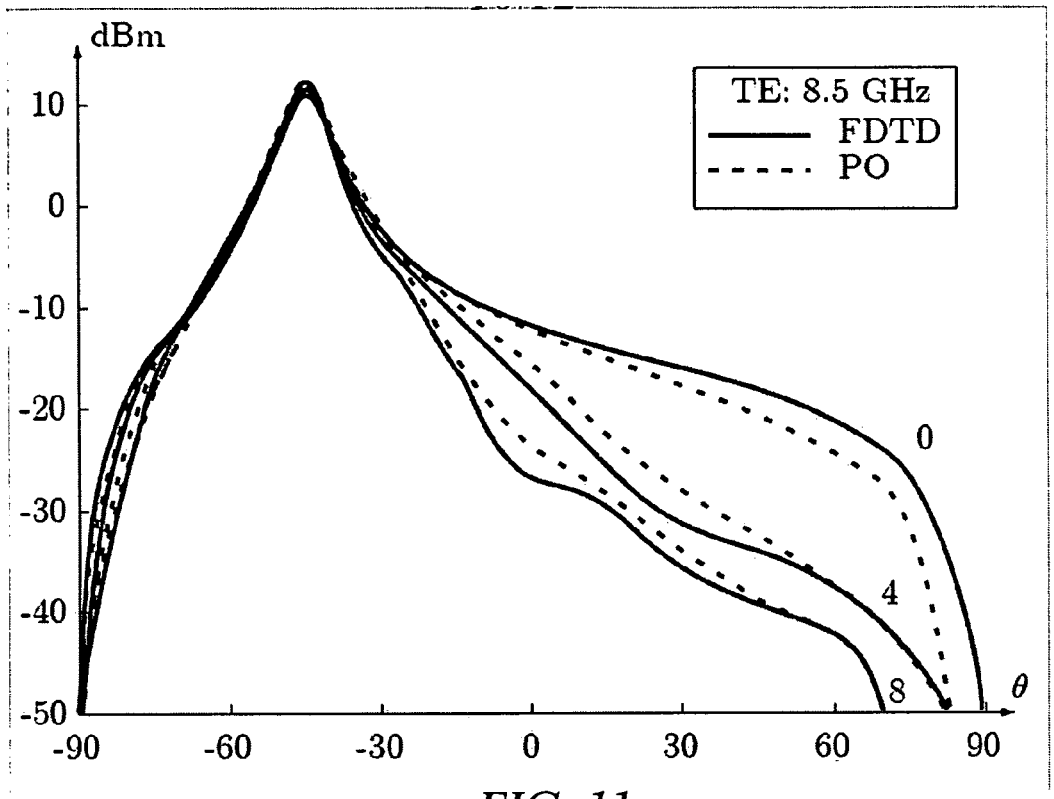
FIG. 11*a-d* illustrate a comparison between the bi-static RCS of embodiments of the invention, calculated with FDTD and with the PO-approximation.
Figure 11B:
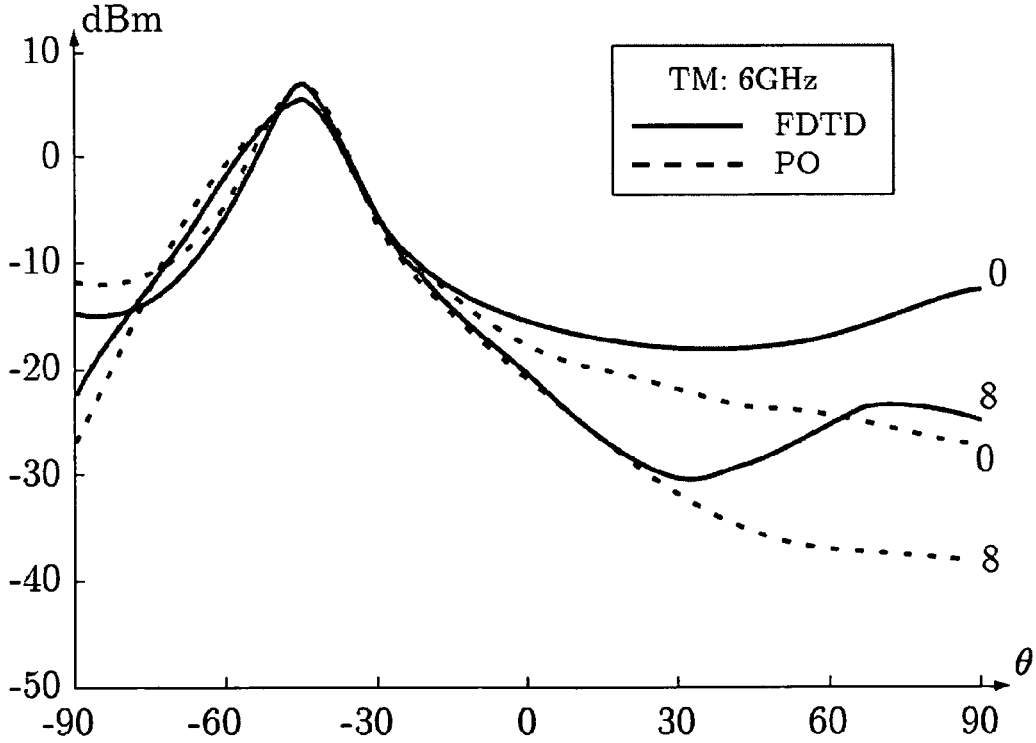
Figure 11C:
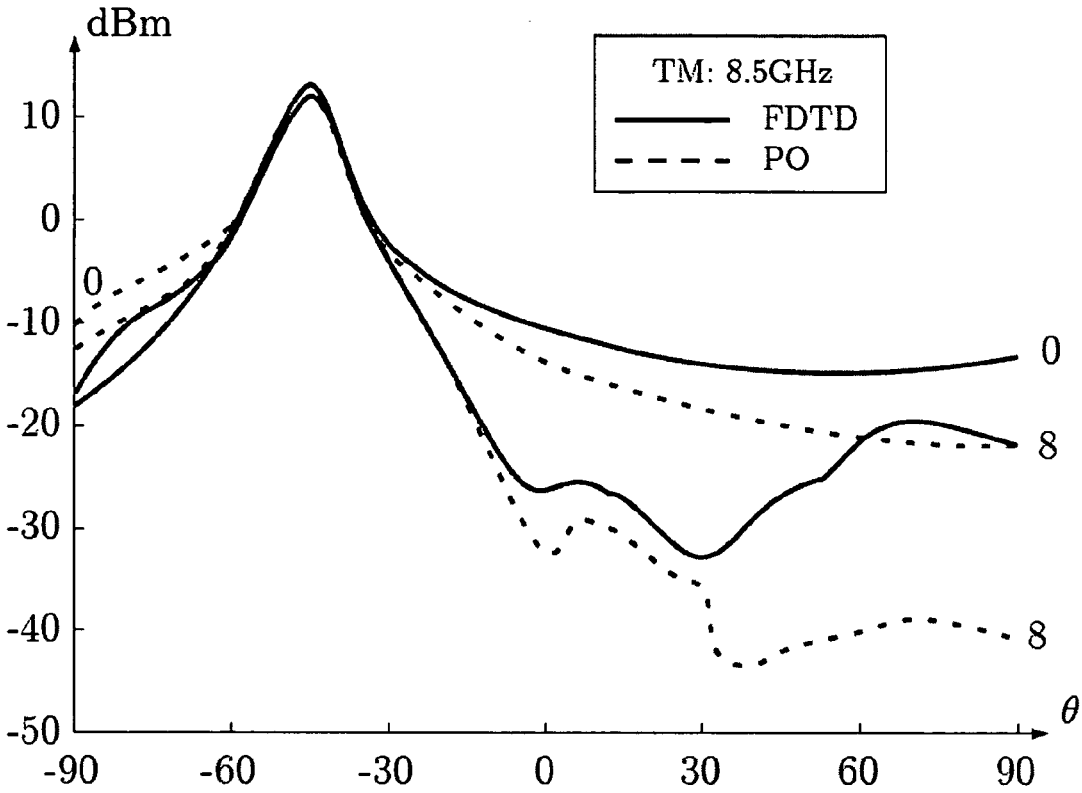
Figure 11D:
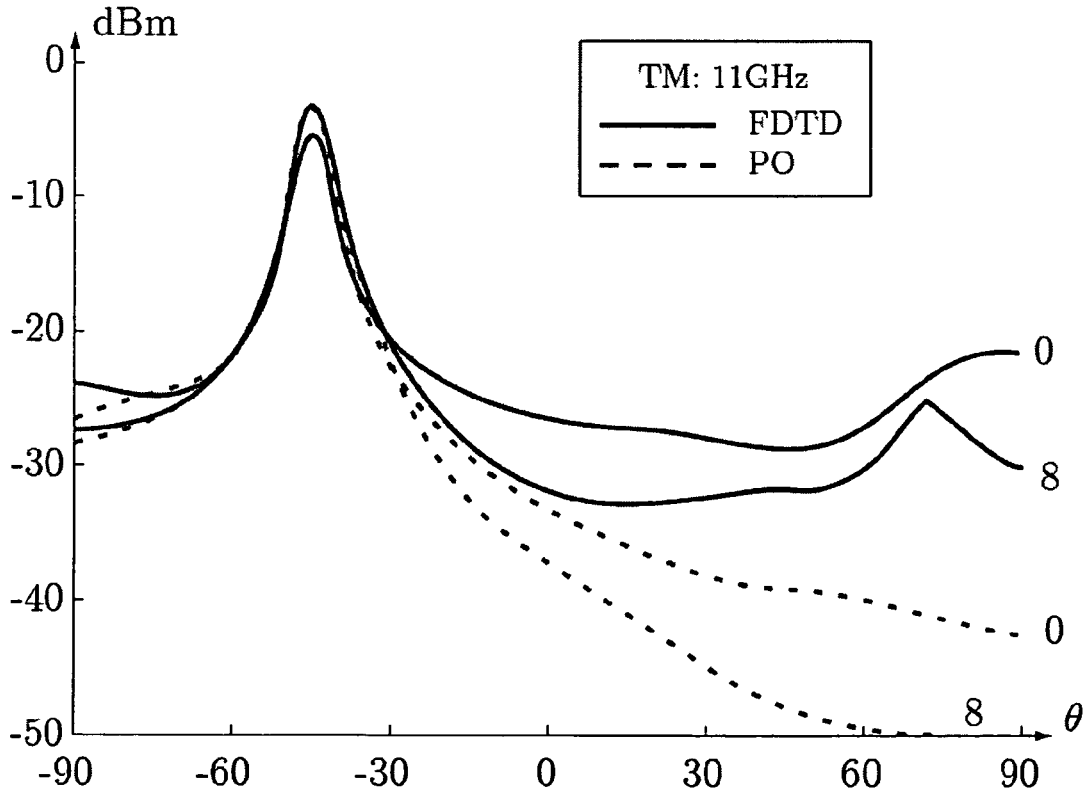

The mono-static RCS is also largest in the passband. Here, the effect of the tapering is considerable. As seen in FIG. 10*c*, the tapering reduces the mono-static RCS with 15 dBm to 20 dBm. The mono-static RCS is also reduced outside the passband with the tapering; however the improvement is not as large as the original RCS is much smaller. In FIGS. 11*a-d*, a comparison between the bi-static RCS calculated with FDTD and with the PO approximation is shown. The envelope of the FDTD and PO results are given by the solid and dashed curves, respectively. It is seen that the PO approximation gives a rough estimate of the RCS for the TE case, as illustrated by FIG. 11*a*.

Surface Waves

Figure 12:
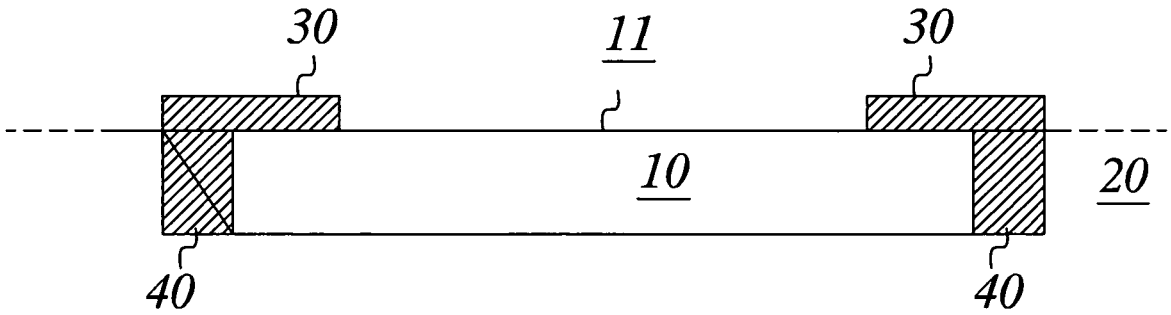
FIG. 12 illustrates a cross section view of a further embodiment of the invention.
Figure 13:
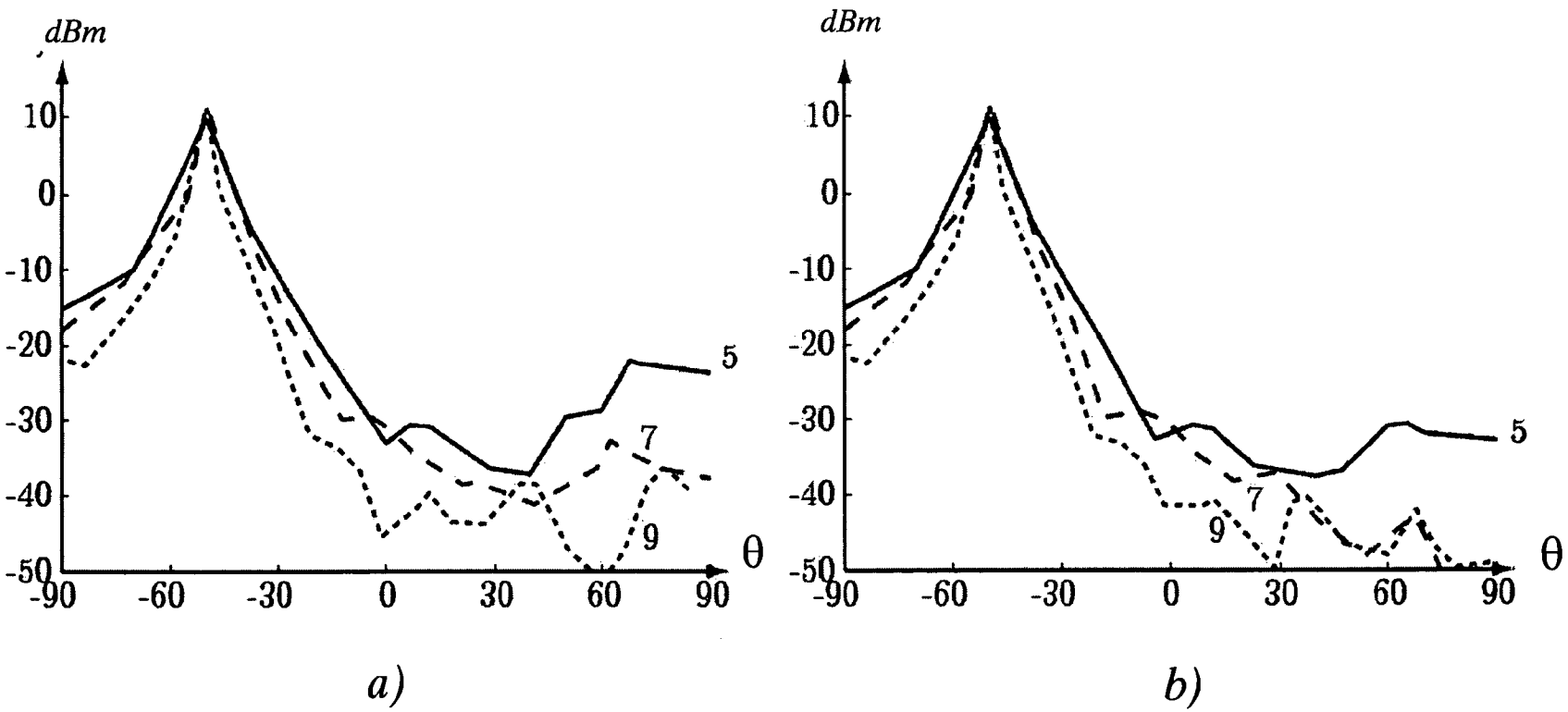
FIGS. 13*a-b* illustrate the effect of the embodiment of FIG. 10.

With reference to FIG. 12, in order to improve the RCS of an antenna array according to the invention even further it is possible to reduce the degrading effect of surface waves. This can be done by the use of an antenna array structure that does not support surface waves. It is according to a specific embodiment, possible to include a RAM into the antenna structure to reduce the degrading effect of surface waves. This is illustrated in FIG. 12 by an antenna structure with an applied transition zone 30 and a RAM structure separating the antenna 10 from the surrounding PEC-material 20 in the interface of the antenna and the surrounding PEC. The transition zone 20 is preferable adapted to extend over the RAM section as well. Numerical simulation indicate that the addition of the RAM section according to the invention absorbs part of the surface waves and reduces the RCS at grazing angles as seen in FIGS. 13*a* and 13*b*.

This invention enables reducing the mono-static radar cross section of an antenna array by providing a resistive sheet adjacent to the interface of the antenna array and the surrounding electrically conducting material e.g. perfectly electrical conductor (PEC).

Specifically, the present invention shows that a tapered resistive sheet can transform the scattering properties of an antenna array to the scattering properties of a surrounding perfectly electrical conductor or PEC in a controlled way. The tapered resistive sheet transforms the reflection coefficient of the infinite antenna along the inverted reactive circles towards the −1 point as the resistivity decreases to zero.

Specifically, applying the RCS in the physical optics (PO) approximation shows that the mono-static RCS reduces uniformly over a large frequency band, a wide angular scattering. Numerical results using FDTD of the RCS from dipole array, a self-complementary array and an FSS radome are also presented to illustrate the reduction of RCS.

Advantages of the present invention include:

Reduced mono-static RCS of antenna arrays.

Transformation of the reflection coefficient of the antenna to that of the surrounding perfectly electrical conductor.

It will be understood by those skilled in the art that various modifications and changes may be made to the present invention without departure from the scope thereof, which is defined by the appended claims.

REFERENCES

[1] J. David Lynch, *Introduction to RF Stealth*, SciTech Publishing Inc., 5601 N. Hawthorne Way, Raleigh, N.C. 27613, 2004.

[2] B. Munk, *Finite Antenna Arrays and FSS*. John Wiley & Sons, New York, 2003.

[3] S. J. Orfanidis, *Electromagnetic Waves and antennas*, 2002 www.ece.rutsers.edu/~orfanidi/ewa, revision date Jun. 21, 2004.

[4] E. F. Knott, J. F. Shaeffer, and M. T. Tuley, *Radar cross section*, SciTech Publishing Inc., 5601 N. Hawthorne Way, Raleigh, N.C. 27613, 2004.

[5] J. D. Kraus and R. J. Marhefka, Antennas, 3rd ed. New York: McGraw-Hill, 2002.

[6] E. F. Knots, *Suppression of edge scattering with impedance strings*, IEEE Trans. Antennas Propagat., 45(12), 1768-1773, 1997.

[7] J. R. Natzke and J. I. Volakis, *Characterization of a resistive half plane over a resistive sheet*, IEEE Trans. Antennas Propagat., 41(8), 1063-1068, 1993.

[8] T. B. A. Senior, *Backscattering from resistive strips*, IEEE Trans. Antennas Propagat., 32(7), 7474-751, 1984.

[9] J. L. Volakis, A. Alexanian and J. M. Lin, *Broadband RCS reduction of rectangular patch by using distributed loading*, Electronics Letters, 28(25), 2322-2323, 1992.

[10] R. L. Haupt and V. V. Liepa, *Synthesis of tapered resistive strips*, IEEE Trans. Antennas. Propagat., 35(11), 1217-1225, 1987.

[11] T. B. A. Senior and V. V. Liepa, *Backscatterng from tapered resistive strips*, IEEE Trans. Antennas Propagat., 32(7), 747-751, 1984.

[12] A. F. Peterson, S. L. Ray, and R. Mittra, *Computational Methods for Electromagnetics*, New York: IEEE Press, 1998.

[13] H. Holter and H. Steyskal, *Infinite phased-array analysis using FDTD periodic boundary conditions—pulse scanning in oblique directions*, IEEE Trans. Antennas Propagat., vol. 47, no. 10, pp. 1508-1514, 1999.

[14] D. M. Pozar, *Microwave Engineering*, New York: John Wiley & Sons, 1998.

APPENDIX I

Thin Conductive Sheet

Consider the scattering properties of a sheet with conductivity a $\sigma\rightarrow\infty$ and thickness $d\rightarrow 0$ such that $\sigma d=R^{-1}$ is finite. The complex valued relative permittivity is written:

$$\varepsilon = \varepsilon' + \frac{\sigma}{i\omega\varepsilon_0} = \varepsilon' + \frac{\sigma\eta_0}{ik_0} \tag{18}$$

where $k_0$ is the free space wave number. The vertical part of the wave vector is $$k_2=\sqrt{k_0^2-k_1^2},\ k_{ss}=\sqrt{\epsilon k_0^2-k_1^2} \tag{19}$$

here it is seen that $k_2^{\ 1}\rightarrow\infty$ as $\sigma\rightarrow\infty$. The reflection coefficient is $$r_T = r_{OT}\frac{1-e^{-2ik_{S2}d}}{1-r_{OT}^2e^{-2ik_{S2}d}} \tag{20}$$

where single layer reflection coefficient, $r_{OT}$, is $$r_{OT} = \frac{1-p_T}{1+p_T} \tag{21}$$

and $$p_{TE} = \frac{k_{S2}}{k_z},\ p_{TM} = \frac{\varepsilon k_z}{k_{S2}} \tag{22}$$

The single layer reflection coefficient has the Taylor expansion $$r_{OT} \approx -1 + \frac{2}{p_T} \tag{23}$$

Expand the reflection coefficient of the conductive sheet $$r_T \approx \frac{-2ik_{S2}d}{\frac{4}{p_T}+2ik_{S2}d} \approx \frac{-\eta_T}{2R+\eta_T} \tag{24}$$

The transmission coefficient is similarly given by $$t_T \approx \frac{2R}{2+\eta_T} \tag{25}$$

APPENDIX II

Normalization of Reflection Coefficients

Assume that the reflection coefficient $$r = \frac{Z-R}{Z+R'}\frac{Z}{R} = \frac{1-r}{1+r} \tag{26}$$

is given. The reflection coefficient normalized to $R_1$ is then given by $$\begin{aligned} r_1 &= \frac{Z-R_1}{Z+R_1'}\frac{Z}{R_1} \\ &= \frac{1-r_1}{1+r_1} \end{aligned} \tag{27}$$

With the reflection coefficient of the normalization impedance $$\begin{aligned} r_0 &= \frac{R_1-R}{R_1+R'}\frac{R_1}{R} \\ &= \frac{1-r_0}{1+r_0} \end{aligned} \tag{28}$$

we have $$\begin{aligned} r_1 &= \frac{\frac{1-r}{1+r}-\frac{1-r_0}{1+r_0}}{\frac{1-r}{1+r}+\frac{1-r_0}{1+r_0}} \\ &= \frac{(1-r)(1+r_0)-(1-r_0)(1+r)}{(1-r)(1+r_0)+(1-r_0)(1+r)} \\ &= \frac{r_0-r}{1-rr_0} \end{aligned} \tag{29}$$

This is a Möbius transformation.

The invention claimed is:

1. An antenna structure, comprising:

an antenna with at least one outer main surface, said antenna is integrated in a surface of a surrounding material, a transition zone arranged along the perimeter of said main surface and overlapping said main surface, said transition zone comprising a layer of a resistive material configured with a resistivity that varies with the distance from an outer perimeter of said transition zone to enable a smooth transition of the scattering properties between the antenna and the surrounding material.

2. The antenna structure according to claim 1, wherein an outer perimeter of said transition zone coincides with the perimeter of said main surface.

3. The antenna structure according to claim 1, wherein said transition zone is arranged overlapping said surrounding material.

4. The antenna structure according to claim 1, wherein the resistivity of said layer is equal to zero at said outer perimeter of said transition zone and approaches infinity at an inner perimeter of said transition zone.

5. The antenna structure according to claim 1, wherein the resistivity of said layer is equal to that of said surrounding material at the outer perimeter of said transition zone.

6. The antenna structure according to claim 1, wherein said surrounding material comprises a perfect electrical conductor.

7. The antenna structure according to claim 1, wherein the resistivity at least partly varies linearly with the distance from the outer perimeter of the transition zone.

8. The antenna structure according to claim 1, wherein the resistivity at least partly varies step wise with the distance.

9. The antenna structure according to claim 1, wherein the resistivity at least partly varies as a cubic spline of the distance.

10. The antenna structure according to claim 1, further comprising a radar absorbing material arranged under the resistive layer and between the antenna and the surrounding material along the perimeter of said main surface to reduce the degrading effect of surface waves.

11. The antenna structure according to claim 1, wherein said surrounding material comprises a conductive material.

12. The antenna structure according to claim 1, further comprising a radome arranged between said main surface and said transition zone.

13. An antenna structure for integration in a surface of a surrounding material, said antenna structure comprising:

an antenna with at least one main surface;

a transition zone arranged along the perimeter of said main surface and overlapping said main surface;

said transition zone comprising a layer of a resistive material adapted to have a resistivity that varies with the distance from an outer edge of the transition zone to enable a smooth transition of the scattering properties between the antenna and the surrounding material.

14. A method of improving the scattering properties of an antenna with at least one outer main surface, where said antenna is integrated in a surface of a surrounding material, said method comprising:

providing a transition zone along the perimeter of said main surface and overlapping said main surface, said transition zone comprising a layer of a resistive material configured with a resistivity that varies with the distance from an outer perimeter of said transition zone to enable a smooth transition of the scattering properties between the antenna and the surrounding material.

* * * * *

UNITED STATES PATENT AND TRADEMARK OFFICE

CERTIFICATE OF CORRECTION

PATENT NO. : 7,403,152 B2
APPLICATION NO. : 11/361058
DATED : July 22, 2008
INVENTOR(S) : Gustafsson It is certified that error appears in the above-identified patent and that said Letters Patent is hereby corrected as shown below:

On the Face Page, in Field (56), under "OTHER PUBLICATIONS", in Column 2, Lines 11-12, delete "Antennas." and insert -- Antennas --, therefor.

In Column 1, Line 42, delete "[[1, [2, [3]." and insert -- [1], [2], [3]. --, therefor.

In Column 1, Line 45, delete "[[4]." and insert -- [4]. --, therefor.

In Column 3, Line 19, delete "[[5]." and insert -- [5]. --, therefor.

In Column 3, Line 34, in Equation (2), delete " $E_1(x;\hat{k})=E_i(\hat{k})e^{-ik\hat{k}\cdot x}$ " and insert -- $E_i(x;\hat{k})=E_i(\hat{k})e^{-ik\hat{k}\cdot x}$ --, therefor.

In Column 4, Line 51, delete "ρ0" and insert -- ρ --, therefor.

In Column 4, Line 53, delete " $\hat{k}=\sin\theta\cos\phi\hat{x}+\sin\theta\sin\phi\hat{x}30\cos\theta\hat{z}.$ " and insert -- $\hat{k}=\sin\theta\cos\phi\hat{x}+\sin\theta\sin\phi\hat{x}+\cos\theta\hat{z}.$ --, therefor.

In Column 4, Line 60, in Equation (9), delete " $\cos^2\theta\frac{|\rho+1|^2}{\pi}\frac{\sin^2(ka\sin\theta\cos\phi)\sin^2(ka\sin\theta\sin\phi)}{k^2a^2\sin^2\theta\cos^2\phi k^2a^2\theta\sin^2\phi}$ " and insert -- $\cos^2\theta\frac{|\rho+1|^2}{\pi}\frac{\sin^2(ka\sin\theta\cos\phi)}{k^2a^2\sin^2\theta\cos^2\phi}\frac{\sin^2(ka\sin\theta\sin\phi)}{k^2a^2\sin^2\theta\sin^2\phi}$ --, therefor.

In Column 5, Lines 32-33, delete "[6, [4]." and insert -- [6], [4]. --, therefor.

In Column 5, Line 34, delete "[4, [7, [8]." and insert -- [4], [7], [8]. --, therefor.

UNITED STATES PATENT AND TRADEMARK OFFICE

CERTIFICATE OF CORRECTION

PATENT NO. : 7,403,152 B2
APPLICATION NO. : 11/361058
DATED : July 22, 2008
INVENTOR(S) : Gustafsson It is certified that error appears in the above-identified patent and that said Letters Patent is hereby corrected as shown below:

In Column 5, Line 37, delete "[1, [9]." and insert -- [1], [9]. --, therefor.

In Column 5, Line 38, delete "[10, [11]." and insert -- [10], [11]. --, therefor.

In Column 6, Line 29, delete "and $\sigma\approx\infty$" and insert -- $\sigma\approx\infty$ and --, therefor.

In Column 6, Line 63, delete "$\eta_R 1+\rho_R$." and insert -- $\tau_R= 1+\rho_R$. --, therefor.

In Column 7, Line 48, delete "$\rho=+1$." and insert -- $\rho=\pm i$. --, therefor.

In Column 8, Line 8, delete "+45°" and insert -- ±45° --, therefor.

In Column 8, Line 17, delete "$f_i \cdot f \cdot f_u$." and insert -- $f_l \cdot f \cdot f_u$. --, therefor.

In Column 8, Line 21, delete "$f_i$." and insert -- $f_l$. --, therefor.

In Column 8, Line 25, delete "[2, [3, [14]." and insert -- [2], [3], [14]. --, therefor.

In Column 8, Line 51, delete "–60'" and insert -- –60° --, therefor.

In Column 8, Line 58, delete "5 (Hz" and insert -- 5 GHz --, therefor.

In Column 8, Line 67, delete "rating" and insert -- grating --, therefor.

In Column 9, Line 13, delete "FFS" and insert -- FSS --, therefor.

In Column 10, Line 43, delete "Knots," and insert -- Knott, --, therefor.

UNITED STATES PATENT AND TRADEMARK OFFICE

CERTIFICATE OF CORRECTION

PATENT NO. : 7,403,152 B2
APPLICATION NO. : 11/361058
DATED : July 22, 2008
INVENTOR(S) : Gustafsson It is certified that error appears in the above-identified patent and that said Letters Patent is hereby corrected as shown below:

In Column 10, Line 58, delete "Backscatterng" and insert -- Backscattering --, therefor.

In Column 11, Line 64, in Equation (25), delete " $t_T \approx \frac{2R}{2+\eta_T}$ " and insert -- $t_T \approx \frac{2R}{2R+\eta_T}$ --, therefor.

Signed and Sealed this

Seventh Day of July, 2009

JOHN DOLL
*Acting Director of the United States Patent and Trademark Office*